US007063077B2

(12) United States Patent
Rodriguez-Amaya et al.

(10) Patent No.: US 7,063,077 B2
(45) Date of Patent: Jun. 20, 2006

(54) ELECTROMAGNETIC VALVE-ACTUATED CONTROL MODULE FOR CONTROLLING FLUID IN INJECTION SYSTEMS

(75) Inventors: Nestor Rodriguez-Amaya, Stuttgart (DE); Uwe Schmidt, Vaihingen/Ensingen (DE); Ramon Junker, Kirkel (DE); Hubert Greif, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 228 days.

(21) Appl. No.: 10/149,195

(22) PCT Filed: Sep. 28, 2001

(86) PCT No.: PCT/DE01/03737

§ 371 (c)(1),
(2), (4) Date: Aug. 29, 2002

(87) PCT Pub. No.: WO02/31342

PCT Pub. Date: Apr. 18, 2002

(65) Prior Publication Data

US 2003/0102391 A1 Jun. 5, 2003

(30) Foreign Application Priority Data

Oct. 11, 2000 (DE) ..... 100 50 238

(51) Int. Cl.
*F02M 37/04* (2006.01)

(52) U.S. Cl. ..... 123/506; 123/467

(58) Field of Classification Search ..... 123/500, 123/501, 498, 458, 446, 447, 506, 461; 239/88–96, 239/585.1–585.5

See application file for complete search history.

(56) References Cited

U.S. PATENT DOCUMENTS

| | | | | | |
|---|---|---|---|---|---|
| 3,817,488 | A | * | 6/1974 | Mack | 251/30.03 |
| 3,851,635 | A | * | 12/1974 | Murtin et al. | 123/448 |
| 4,428,346 | A | * | 1/1984 | Hoshi | 123/450 |
| 4,463,969 | A | * | 8/1984 | Harrison | 280/5.514 |
| 4,583,509 | A | * | 4/1986 | Schechter et al. | 123/451 |
| 4,831,986 | A | * | 5/1989 | Linder et al. | 123/449 |
| 4,856,713 | A | * | 8/1989 | Burnett | 239/113 |
| 5,088,467 | A | * | 2/1992 | Mesenich | 123/531 |
| 5,239,968 | A | * | 8/1993 | Rodriguez-Amaya et al. | 123/506 |
| 5,339,777 | A | * | 8/1994 | Cannon | 123/90.12 |
| 5,494,219 | A | * | 2/1996 | Maley et al. | 239/88 |
| 5,771,865 | A | * | 6/1998 | Ishida | 123/467 |
| 6,113,014 | A | * | 9/2000 | Coldren et al. | 239/585.1 |

FOREIGN PATENT DOCUMENTS

| | | | |
|---|---|---|---|
| DE | 19629107 | * | 1/1998 |
| DE | 19910970 | * | 9/2000 |
| EP | 0987430 | * | 3/2000 |

* cited by examiner

*Primary Examiner*—Carl S. Miller
(74) *Attorney, Agent, or Firm*—Ronald E. Greigg

(57) ABSTRACT

The invention relates to a control module for fluid control in injection systems, having a valve body (2) in which valve needles (6, 24) of control valves (5, 17) are received. With these control valves (5, 17), the pressure buildup or pressure relief of control chambers (30) or nozzle chambers of injectors can be varied. The control valves (5, 17) in the valve body (2) are electromagnetically actuatable, and magnet coils are received in recesses (9, 20) of insert elements (19, 32) or in recesses (9) in the valve body itself.

9 Claims, 3 Drawing Sheets

ELECTROMAGNETIC VALVE-ACTUATED CONTROL MODULE FOR CONTROLLING FLUID IN INJECTION SYSTEMS

CROSS-REFERENCE TO RELATED APPLICATIONS

This application is a 35 U.S.C. 371 application of PCT/DE01/03737, filed on Sep. 28, 2001.

BACKGROUND OF THE INVENTION

If the ever more stringent regulations for motor vehicle emissions are to be met, it is necessary for the fuel combustion proceeding in internal combustion engines to be shaped, via injection courses that can be varied, in such a way that an optimal course of combustion in terms of emissions can be achieved. This requires an injection system that is equipped with actuating devices that have the shortest possible response times and that impose precisely defined stroke paths on the control valves of a control module in injection systems. High demands in terms of durability and operational reliability must be made of these actuating devices.

PRIOR ART

An injection system configured for meeting the above legal specifications requires actuating devices that on the one hand must have a long service life and on the other must have high operating reliability. Moreover, via the actuating devices, short control valve trigger times must be attainable; another goal is to steer the valve control body of the control valves into various positions, in order to increase or decrease the injection pressure in controlled fashion.

If piezoelectric actuators are used in injection systems, then short response and switching times for control valves of an injection system can be achieved. However, it remains uncertain whether the piezoelectric actuators already used have the requisite durability for an injection system, and whether the operating reliability still exists after a relatively long time in operation.

In operation in internal combustion engines, especially internal combustion engines used in utility vehicles, piezoelectric actuators are exposed to extremely severe conditions in use, such as temperature fluctuations and jarring. Utility vehicles are usually designed for a life of 1 million kilometers or more, and hence the durability of an injection system must also be designed for such a long life.

From European Patent Disclosure EP 0 823 549 A2, an injector for an injection system in internal combustion engines is known. In the injector housing of this reference, two in-line control valves are provided, which are triggered by a magnet. The triggering of one of the two valves necessarily causes the actuation of the other valve as well. The advantage of this embodiment is the pressure equilibrium of the needle control valve in all operating states, while conversely there is also the disadvantage that decoupling of the reciprocation events of the two in-line valves cannot be done, which limits the capabilities of exerting influence to shape the course of injection.

SUMMARY OF THE INVENTION

The embodiment proposed according to the invention, by means of a miniaturized control part design, offers the advantage of creating a compact control module. Both the durability and reliability of electromagnets used as a switching device are also an undisputed and generally acknowledged technical fact. By miniaturizing the components with a corresponding flux density to be achieved in the electromagnet coil in cooperation with the magnet yoke surrounding the coil, a degree of compactness of the control module in an injection system is attained such that it is possible to accommodate such a control module in existing systems, for instance in utility vehicle motors, without major changes in the installation space.

Advantages in terms of installation space can even be attained by means of a reduced-size version of the control module proposed according to the invention, since the lateral attachments on the injector that are required in piezoelectric actuators for injection of fuel at high pressure into the combustion chambers of an internal combustion engine can be omitted entirely.

The actuating devices, embodied as electromagnets, of the control module proposed according to the invention can be switched, depending on their function, such that both control valves of the control module are closed when without current, or both control valves can be switched into the open position when without current. This is preferably achieved by means of spring elements provided on the control valve bodies of the control valves. However, it is also possible to keep one of the two control valves closed when without current, while positioning the other control valve into the open state when without current.

In the control module proposed according to the invention, a variant embodiment, with a favorable effect on both the possible uses and the space needed, allows disposing the magnet yoke—the nonmoving part of the electromagnet—in the valve body of the control module, by suitable recessing for accommodating the coil. As a result, the material of the valve body can simultaneously serve as a magnetic conductor, which lowers the cost. The recesses that receive the magnet coils in the valve body can also be disposed in separate components, which can for instance be made from a high-quality soft-magnetic material. A combination of these two possibilities for disposing or accommodating the magnet coils of an electromagnet is also possible.

If separate inserts that receive the magnet coils are built into the valve body of the control module, then they can be connected to the valve body by various methods. On the one hand, it is possible for the insert elements, which receive the magnet coils and are provided with annular recesses, to be screwed into the valve body; on the other hand, the insert elements, surrounding the magnet coils in cup-shaped fashion, can also be conceived of as being press-fitted or clamped into the valve body. Moreover, a positive-engagement connection of the insert element receiving the recess for the magnet coil to the valve body can be done by material-engagement connection, such as soldering or welding.

In a way that favorably affects the production costs, the valve needles for both control valves can be made with the same diameter. As a result, identical production methods can be employed; moreover, stockpiling and storage costs can be favorably affected by the principle of using identical parts.

BRIEF DESCRIPTION OF THE DRAWINGS

The invention is described in further detail below in conjunction with the drawing; in which FIG. 1, a control module with recesses for magnet coils, the recesses being received parallel but with a height offset from one another, for magnet coils.

DESCRIPTION OF THE PREFERRED EMBODIMENTS

Figure 1:
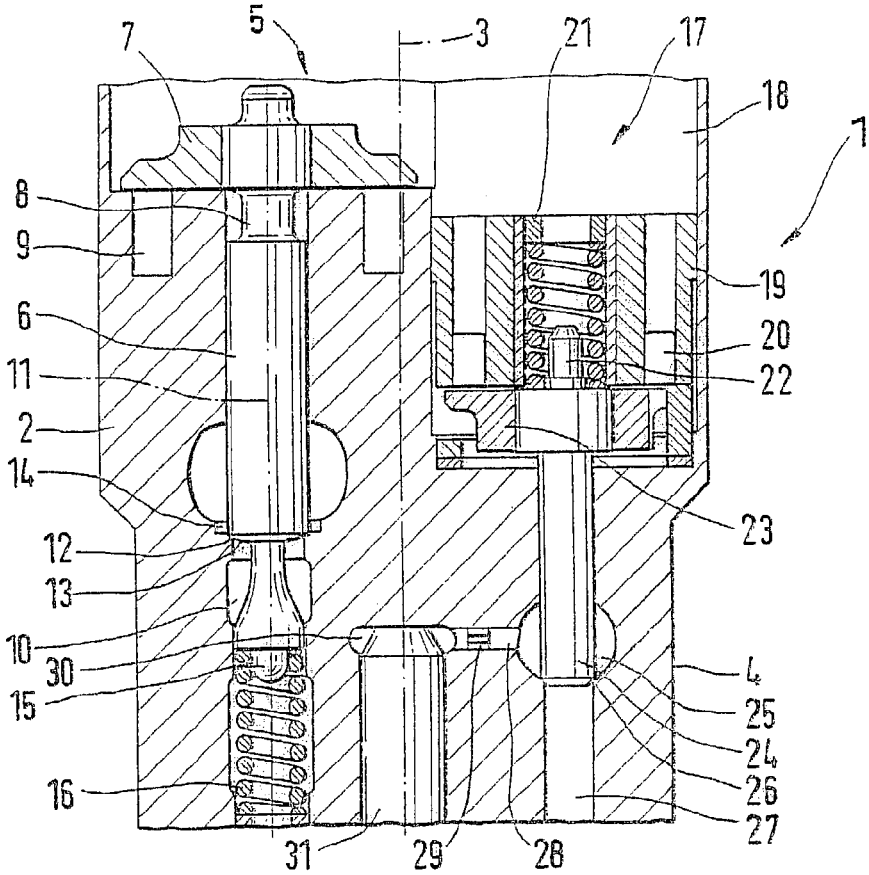

FIG. 1 shows a detailed section through the control module, proposed according to the invention, with recesses, received parallel therein but with a height offset from one another, for electromagnets that actuate the valve control bodies.

In a sectional view, FIG. 1 shows that in a valve body 2 of the control module 1, which valve body is received symmetrically to its axis of symmetry 3, two control valves 5, 17 acting parallel to one another are received. The first control valve 5 includes an essentially vertically extending valve needle 6. The valve needle 6 is embodied as a rotationally symmetrical component that is symmetrical to the line of symmetry 11. An annular magnet armature 7 is received in the upper region of the valve needle 6 and surrounds the valve needle 6 over the full surface area above a taper 8 thereon.

In the part of the valve body 2 located below the radial width of the magnet armature 7, an encompassing recess 9 is embodied for receiving the magnet coil of an electromagnet. The region of the valve body 2 surrounding the recess 9 in the valve body 2 can therefore be considered to be the magnet yoke of the electromagnet. In the lower region of the first control valve, a leak fuel chamber 10 surrounding the constriction point of the valve needle 6 is embodied.

Located above the leak fuel chamber 10 in the valve body 2 is the valve seat 12, closed by the seat face of the valve needle 6, by way of which seat the annular chamber 14 embodied in the valve body 2 can be pressure-relieved. On the lower end of the valve needle 6, there is a mandrel 15, which serves as a guide face for the first few windings of a spring element 16, which is also supported, as a restoring element, in the valve body 2.

Also received in the valve body 2 is a second control valve 17, which is described with a height offset relative to the first control valve 5 already described. A bore 18 is received in the valve body 2 of the control module 1, and an annularly configured insert element 19 is let into this bore. In the annularly configured insert element 19, which comprises a high-quality soft-magnetic material, there is a recess 20 for the coil of an electromagnet. The annularly configured insert element 19 is pierced by a bore with a sleeve let into it. A compression element is braced on one end on a ring 21 secured to the sleeve, and on the other end it is guided in a mandrel-shaped extension 22, which is embodied on the valve needle 24 of the second control valve 17. Below the mandrel 22, the valve needle 24 of the second control valve 17 is provided with a platelike element or valve plate 23, which can be moved vertically up and down by the electromagnet, whose coil is received in the recess 20 of the insert element 19.

In the lower region of the second control valve 17, there is an annular chamber 25 annularly surrounding the valve needle 24. On the lower end of the valve needle 24, the valve seat 26 is embodied, which opens and closes the annular chamber 25 that surrounds the valve needle 24.

Coaxially to the axis of symmetry 3 of the valve body 2, there is an injector piston 31 in the valve body 2; its conically tapering end protrudes into a control chamber designated by reference numeral 30. The control chamber 30 has an inlet, not shown, and an annular outlet 28, which can have a throttle element 29 let into it. The annular chamber outlet 28 discharges into the annular chamber 25, which surrounds the lower region of the valve needle 24 of the second control valve 17. An outlet 27 branches off from the annular chamber 25, and by way of this outlet the control volume emerging from the control chamber 30 drains into a reservoir.

Figure 2:
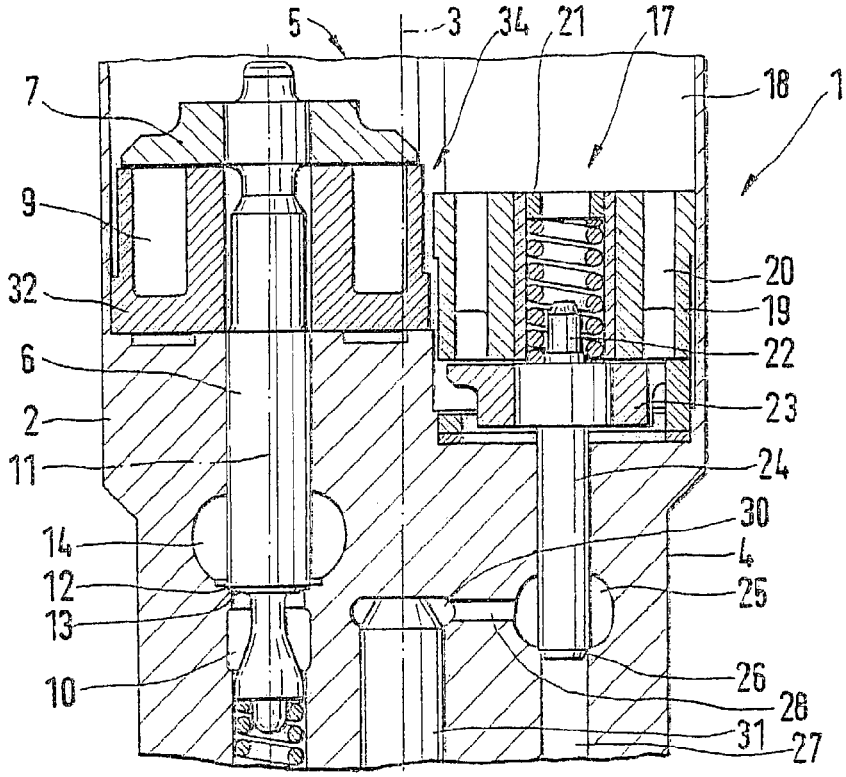
FIG. 2, a control module of FIG. 1, in which a separate receiving element for the magnet coil is let into the valve body on one of the control parts.

FIG. 2 shows a control module of FIG. 1 in further detail, in which a separate receiving element for a magnet coil is let into the valve body at one of the control valves.

From a comparison of FIG. 1, already described, and FIG. 2, it can be seen that the part located to the right of the line of symmetry 3 of the valve body 2, that is, the second control valve 17 in FIG. 2, is identical to the control valve 17 of FIG. 1. The sole difference is that there is no throttle element 29 in the annular chamber inlet 28 in the configuration of FIG. 2.

In a distinction from the variant embodiment, described in FIG. 1, of the first control valve 5, the electromagnet that activates the first control valve 5, that is, its magnet coil, is located in recesses 9 of an insert element 32, which is maximally surrounded by the valve body 2. In a preferred possible design for the insert element 32, this element can be made from high-quality soft-magnetic material. To improve the switching dynamics, the material of the insert element 32 serving as a magnet yoke can be provided with recesses extending axially in slitlike form. Preferably, slitlike-configured recesses can be embodied on the insert element or also in the valve body 2 in the region of the recesses 9 for receiving the magnet coils. The insert element 32 shown in FIG. 2 can either be screwed into the valve body 2 or press-fitted into it or clamped into it or welded or soldered to it, in order to enter into a permanent connection with the valve body 2 of the control module 1.

Analogously to FIG. 1, in a variant embodiment of the control module 1 of the invention that has a height offset 34 of the control valves 5 and 17 to one another, there is a control chamber 30 into which the conically tapering end of an injector piston 31 protrudes. The control chamber 30 in the valve body 2 can be pressure-relieved via the annular chamber inlet 28, the annular chamber 25, the second control valve 17, and the outlet 27 communicating with them.

Figure 3:
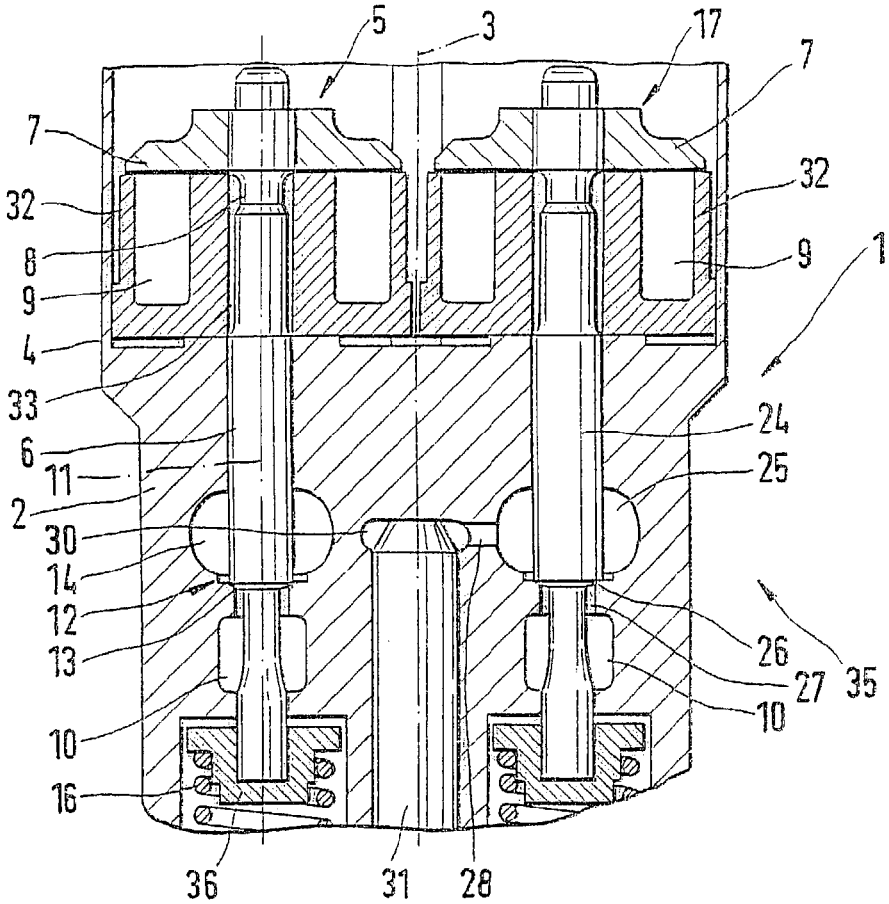
FIG. 3, the parallel disposition of two control parts in the valve body with separate receiving inserts for receiving the magnet coils.

FIG. 3 shows the parallel disposition of two control valves in the valve body with insert elements for receiving the magnet coils of electromagnets in further detail.

FIG. 3 shows that the two control valves 5 and 17 received in the valve body 2 of the control module 1 are structurally exactly identical. The valve needles 6 and 24 of the first control valve 5 and second control valve 17, respectively, are embodied with the same diameter, making it possible to attain production of the control module proposed according to the invention and in accordance with FIG. 3 by the principle of identical parts. The use of identical parts is especially simple from a production standpoint and helps keep production costs low.

In the case of the valve needles 6 and 24 of the two control valves 5, 17, respectively, that are received in the valve body, a cup-shaped needle receiving element 36 is assigned on the lower end, which element is engaged via the spring 16 braced at the bottom—not shown here—on the valve body 2. As a result, a restoring force can be imposed on the valve needles 6 and 24 of the first control valve and second control valve 17, respectively.

From FIG. 3, it can be seen that the magnet coils of the electromagnets that actuate or activate the control valves 5 and 17 are surrounded in recesses 9 by insert elements 32. In this version of the control module of the invention, the magnet coils are received in separate built-in parts in the valve body 2. Analogously to the provisions shown in FIG. 2, the insert elements 32 can be let into the valve body 2 side by side. Both insert elements 32 can be identical components, and both insert elements 32 preferably comprise a high-quality soft-magnetic material acting as a magnet yoke.

In this embodiment of the control module 1 proposed according to the invention as well, the insert elements 32, in whose recesses 9 the magnet coils of the electromagnets are received, can be screwed to the valve body 2, press-fitted into it, or clamped to it. A connection between the valve body 2 and insert element 32 by positive engagement, such as by welding or soldering, is also conceivable. The configuration of the annular chambers 14 and 25, the leak fuel chambers 10, the corresponding sealing seats 13 and 26, and the disposition of injector pistons 31, the control chamber 30 in the valve body, and the annular chamber inlet 28 and annular chamber outlet 27 are identical to the configurations already sketched in FIGS. 1 and 2.

Figure 4:
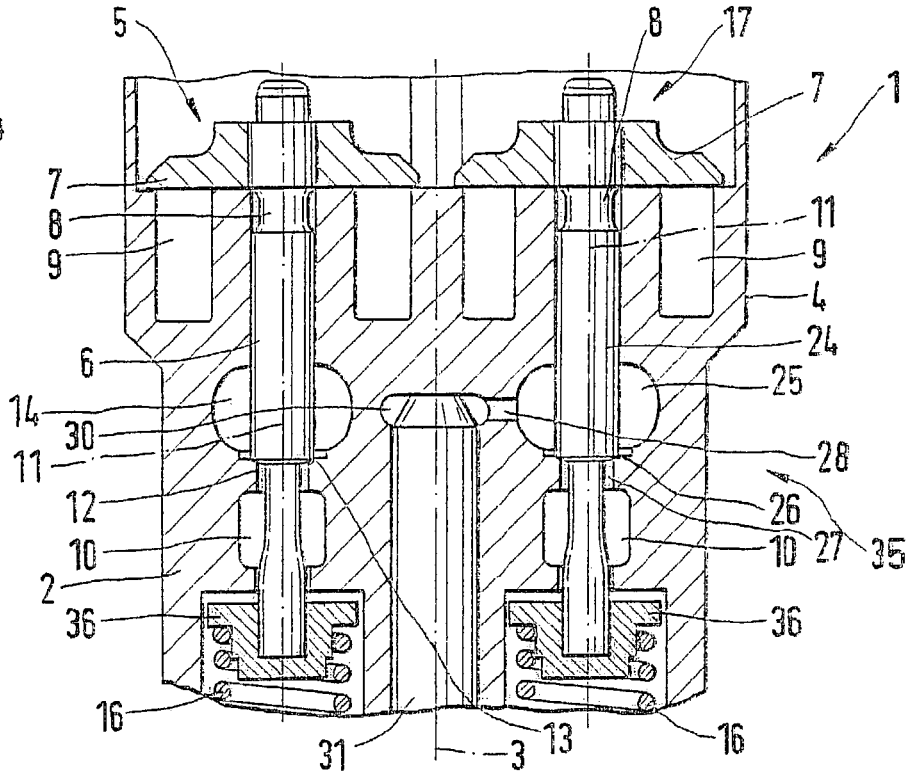
FIG. 4, the parallel disposition of two control valves in the control module, whose actuating magnet coils are both received in recesses in the valve body.

From FIG. 4, the parallel disposition of two control valves is shown in further detail; their actuating magnet coils are both received in recesses of a valve body.

In this embodiment, an especially low-height configuration of a control module 1 for fluid control, for instance in injection systems that inject fuel that is at high pressure, can be achieved by providing that the recesses 9 that receive the magnet coils are embodied directly in the valve body 2. Thus the material comprising the valve body 2 can advantageously be employed as a magnetic conductor. Moreover, the insert elements 32 of high-quality soft- magnetic material, which increase the structural height of the valve body, can be omitted. The annular magnet armatures 7 received on the valve needles 6 and 24 convert the axial reciprocating motion, which is generated by the switching of the magnet coils that are received in the recesses 9 of the valve body 2, into vertical reciprocating motion of the respective valve needles 6 and 24. FIG. 4 shows an embodiment of a control module 1 that is especially compact in structure; in it, the recesses 9 for the magnet coil, the annular chamber 14 and 25 surrounding the respective valve needles 6 and 24 approximately centrally, the adjoining sealing seat 12 and 26, and the adjoining leak fuel chambers 10 are all located especially close together and in line.

In this embodiment as well, the injector piston is embodied coaxially to the axis of symmetry 3 of the valve body 2.

Figure 5:
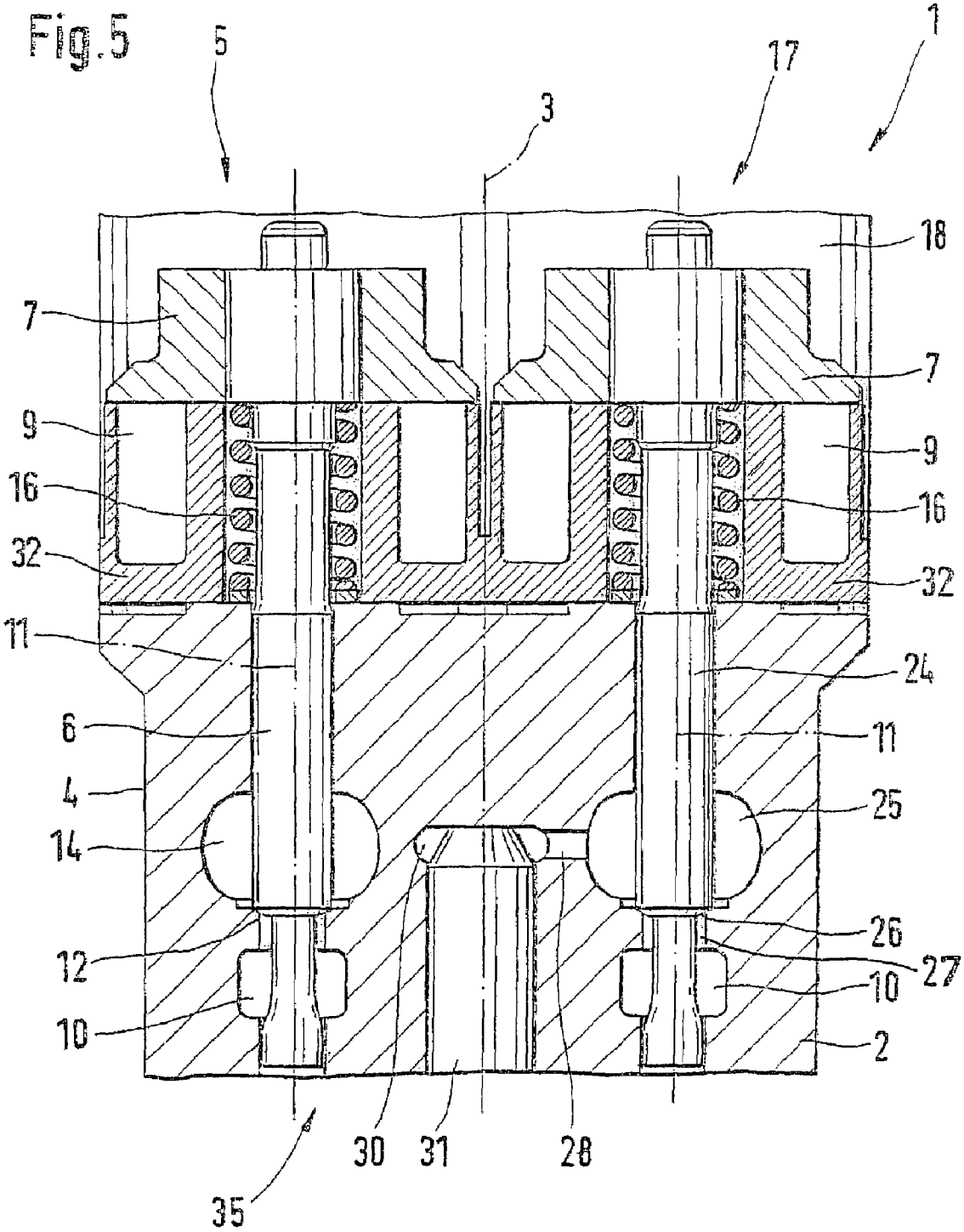
FIG. 5, a variant of a control module with control valves, in which compression springs surround the control valve bodies in their upper region.

The embodiment of FIG. 5 shows a variant of a control module with control valves in which spring elements are embodied surrounding the control valve bodies in their upper region.

Unlike the parallel dispositions of the control valves 5 and 17 in the valve body 2 of the control module 1 shown in FIGS. 3 and 4, in the variant embodiment of FIG. 5 the spring elements 16 are each located in the upper region of the valve body 2. The spring elements 16 are penetrated on the one hand by the valve needles 6 and 24 and to avoid kinks are located on the insides of bores in the insert elements 32. The insert elements 32 have annularly extending recesses 9, which receive the magnet coils of the electromagnets that actuate the control valves 5 and 17. In this exemplary embodiment of the concept on which the invention is based as well, the insert elements 32 can be made from high-quality soft-magnetic material; moreover, the insert elements 32 can be permanently connected to the valve body 2 of the control module 1 by the already-described methods of screwing, welding, soldering, or press-fitting or clamping. In the upper region of the valve needle 6 and 24, this needle is surrounded by an annular magnetic armature 7; the region of the valve needle 6 and 24 receiving the magnet armature 7 forms a stop face for the compression spring that penetrates the bore in the insert element 32. On the other hand, the compression spring 16, surrounded by the insert element 32, is braced on a ring which in turn rests flat on the valve body 2. With this variant embodiment of the control module 1 proposed according to the invention, the valve body 2 can be optimized to provide that the material surrounding the magnet coils of the electromagnet can be selected optimally in terms of its magnetic properties, regardless of the material comprising the valve body 2.

From FIG. 5, it can be seen that the two control valves 5 and 17 are configured as identical components and do not differ from one another in either diameter or attachment parts. Only the annular chambers 14 and 25, which are embodied in the housing in the valve body 2 and surround the valve needles 6 and 24 in the lower region, differ in terms of the orifice of an annular chamber inlet 28 or an annular chamber outlet 27, which are associated with the annular chamber 25 of the second control valve 17.

From FIGS. 3, 4 and 5, variant embodiments of a control module 1 can be seen in further detail in which the two control valves 5 and 17 contained in the control module are disposed symmetrically to one another and have the same structural height. Moreover, both control valves 5 and 17, that is, their valve needles 6 and 24, respectively, have the same production diameter, so that identical parts can be used.

From FIGS. 1 and 2, it can be seen that inside a valve body 2 of a control module 1, at a first control valve 5, the coil of an electromagnet can be received in recesses 9 embodied in the valve body 2, while the electromagnet of the second control valve 17, also received in the valve body 2, of the control module 1 can be surrounded by an insert of high-quality soft-magnetic material in a bore 18. The same is true for the variant embodiment shown in FIG. 2, in which analogously to FIG. 1 a height offset of the two control valves 5 and 17 to one another can be seen.

The foregoing relates to preferred exemplary embodiments of the invention, it being understood that other variants and embodiments thereof are possible within the spirit and scope of the invention, the latter being defined by the appended claims.

We claim:

1. A control module for fluid control in injection systems for injecting fuel at high pressure, having a valve body with one injector piston, in which valve needles of control valves are received, with which valves the pressure buildup or pressure relief of control chambers or nozzle chambers of an injector can be varied, wherein the control valves in the valve body are received parallel to one another and are electromagnetically actuatable, and magnet coils are received in recesses of the valve body or in recesses of insert elements on the valve body, and wherein the recesses of the valve body or of the insert elements are slitted to improve the switching dynamics.

2. The control module of claim 1, wherein the magnet coils that actuate the control valves are received in recesses of the valve body of the control module.

3. The control module of claim 1, wherein the magnet coils that actuate the control valve are received in recesses of insert elements on the valve body that act as a magnet yoke.

4. The control module of claim 3, wherein the insert elements of the valve body that act as a magnet yoke are made from high-quality soft-magnetic material.

5. The control module of claim 1, wherein the slitting is embodied as continuous slits extending in the axial direction.

6. The control module of claim 1, wherein preferably four slits are made in the valve body or the insert elements.

7. The control module of claim 1, wherein the insert elements in the valve body are received in clamped, press-fitted, nonpositive-engagement or positive-engagement fashion.

8. The control module of claim 2, wherein the recesses, which receive magnet coils of magnets actuating both control valves, are disposed in the valve body with a height offset from one another.

9. The control module of claim 1, wherein the control valves and the magnets actuating them are embodied parallel to one another and with an identical structural height.

* * * * *